US005251999A

United States Patent [19]

McCracken

[11] Patent Number: 5,251,999

[45] Date of Patent: Oct. 12, 1993

[54] SELF-PROPELLED PAVEMENT REPAIR APPARATUS

[76] Inventor: Hilton G. McCracken, 8032 Edith, NE., Albuquerque, N. Mex. 87113

[21] Appl. No.: 866,897

[22] Filed: Mar. 25, 1992

[51] Int. Cl.[5] ..... E01C 19/06

[52] U.S. Cl. ..... 404/109; 404/110

[58] Field of Search ..... 404/75, 103, 107, 108, 404/110, 109, 133.2

[56] References Cited

U.S. PATENT DOCUMENTS 4,215,949 8/1980 Gabriel, Jr. ..... 404/110

4,704,046 11/1987 Yant ..... 404/109

OTHER PUBLICATIONS

"Pothole Contracting Pays Off For New Mexico City", *Roads & Bridges*, Mar. 1992, p. 50.

*Primary Examiner*—William P. Neuder

*Attorney, Agent, or Firm*—Rod D. Baker; Donovan F. Duggan; Deborah A. Peacock

[57] ABSTRACT

The invention pertains to a self-contained, mobile, pavement repair apparatus. A self-propelled, wheeled vehicle is described, upon which are mounted a material supply hopper, a debris storage, an overhead crane arm, and an articulated conveyor arm. Mounted on the business end of the crane arm are various implements for performing pavement repair, all of which are remotely controlled by a single user in an enclosed cab. Asphalt or concrete patching material is transported by an auger from the tiltable supply hopper to an articulated conveyor arm, which conveyor arm deposits the material upon the repair area. The user remotely controls the overhead crane arm in order to position and actuate, from the cab, the various repair implements. All apparatus functions, materials and safety devices necessary to complete the repair process may be operated by a single user.

35 Claims, 8 Drawing Sheets

SELF-PROPELLED PAVEMENT REPAIR APPARATUS

BACKGROUND OF THE INVENTION

1. Field of the Invention (Technical Field)

This invention relates to a self-propelled, self-contained, pavement repair apparatus.

2. Background Art

The apparatus of the present invention preferably is used to repair asphalt pavements, but may be modified to accomplish repairs on other pavement and roadway material types. In the invention, all the necessary implements and materials needed to accomplish a pavement repair are mounted or contained on or in a single manned vehicle. The self-contained and self-propelled character of the apparatus of the invention permits pavement repairs to be made by a single user operating a single mechanized vehicle.

The need for a self-contained asphalt/concrete repair vehicle has been previously recognized. Devices have been constructed in an attempt to permit the cleaning, filling, and tamping of damaged areas in paved roadways to be accomplished from a single vehicle. U.S. Pat. No. 425,949 to Gabriel, Jr., for example, describes a typical such vehicle. Gabriel discloses an apparatus having a supply hopper mounted along one side, used to hold a quantity of asphalt, that can be lowered to allow filling by dump truck or skip loader. After filling, the supply hopper is lifted to a raised position for transport. Gabriel also discloses a distribution hopper mounted on the end of a remotely controlled articulating arm. The distribution hopper, which has an open top, is filled with material by locating it under the forward end of the supply hopper. The supply hopper contains an auger which drives the asphalt forward for discharge into the underlying distribution hopper. The asphalt in the supply hopper is kept warm by the use of an open flame inside the auger tube. The operator of the Gabriel device then moves the filled distribution hopper over an area to be patched and remotely operates a door at the bottom of the distribution hopper, allowing an amount of asphalt to be deposited to the repair area. The asphalt is then compacted by a remotely controlled tamper which is mounted to the distribution hopper. The tamper then compacts the asphalt in place.

The Gabriel device and similar apparatuses present a host of shortcomings. The apparatuses of the existing art often have a limited hopper capacity, necessitating frequent trips for refilling; moreover, hopper design in the existing art often prevents conventional loading from asphalt silos, accentuating the need for loading from dump truck or skip loader. Also, the supply hoppers of present apparatuses often have angled sides, causing premature overcompaction of asphalt material in the hopper, a circumstance that is frequently aggravated by inadequate hopper material temperature control. Existing apparatuses also do not permit the user adequate field of vision to observe all apparatus operations clearly, and often present hazards to passersby in the form of widely swinging mechanical arms and flying debris hurled from high velocity air blower cleaners. Additionally, existing apparatuses do not provide constant heat to material emulsion and cleaning solution conduits, resulting in inconvenient clogging and inefficiency.

The present improved invention has been designed to be user-friendly and will eliminate the problems encountered with the Gabriel and similar vehicles.

SUMMARY OF THE INVENTION (DISCLOSURE OF THE INVENTION)

In accordance with the invention, there is provided a fully self-contained, one-man operated, mechanical, asphalt repair vehicle, and methods for its use.

This apparatus is comprised of a ground vehicle, movable and guidable on a roadway, for repairing asphalt/concrete pavements safely, mechanically and permanantly. The vehicle of the apparatus is a wheeled chassis upon which are mounted various implements and devices utilized in accomplishing a repair. An articulated crane, preferably composed of vertical and horizontal sections, is mounted on the chassis. The vertical and horizontal sections are pivotably connected to each other, the horizontal section is extendable and retractable, and the entire crane is pivotably and rotatably attached to the chassis, allowing great positional freedom of the crane. The various individual tools and implements necessary to accomplish a repair, e.g. jackhammer, scarifier, oil sprayer, torch, and vacuum head are attached to the articulated crane. A single user can position the crane and operate the implements from the safety of an enclosed cab upon the chassis.

Also provided is a controllably tiltable hopper means for storing repair materials as well as detritus cleaned from the area to be repaired. The tiltable aspect of the hopper means permits controlled delivery of repair material while minimizing premature compaction thereof; the hopper means is also heated and insulated.

The invention further provides horizontally pivotable conveyor means, such as a series of conveyor belts atop pivotable horizontally extending arms, for delivering repair material from the hopper means to the particular pavement area to be repaired. Auger means for transporting repair material from the hopper means to the horizontally pivotable conveyor means is disclosed.

Thus, the apparatus and methods of the invention permit a single user to accomplish a repair of a roadway surface or other pavement by manipulating a crane means bearing repair implements, and a separate conveyor means for depositing repair material, both from the comfort and safety of a vehicle cab.

An object of the invention is to provide an improved arm and mounting design, for the placement of the plurality of implements required, which does not impair the single operator's line of vision.

Another object is to provide a vacuum/storage system to remove debris from the selected area.

A further object is to provide a thermostatically controlled heated hopper, to accommodate a sufficient supply of materials for a day's patrol. The hopper will be loaded from conventional material silos, dump trucks, skip loaders or by hand.

An additional objective is to provide a thermostatically controlled heat source for all materials, including liquids, accurately controlled to plus or minus 10 degrees at zero degrees Fahrenheit.

Yet another object is to provide a cab operated, heat controlled transfer auger/conveyor system for precise and exact placement of the materials.

Still another object of the apparatus is to provide additional seating for personnel.

An advantage of the apparatus is the ability to accomplish all required functions by a single operator without disrupting foot or auto traffic.

An advantage of the apparatus is that it permits the user to accomplish all functions of the repair without repositioning the vehicle of the apparatus.

other objects, advantages, and novel features, and further scope of applicability of the present invention will be set forth in part in the detailed description to follow, taken in conjunction with the accompanying drawings, and in party will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

Figure 1:
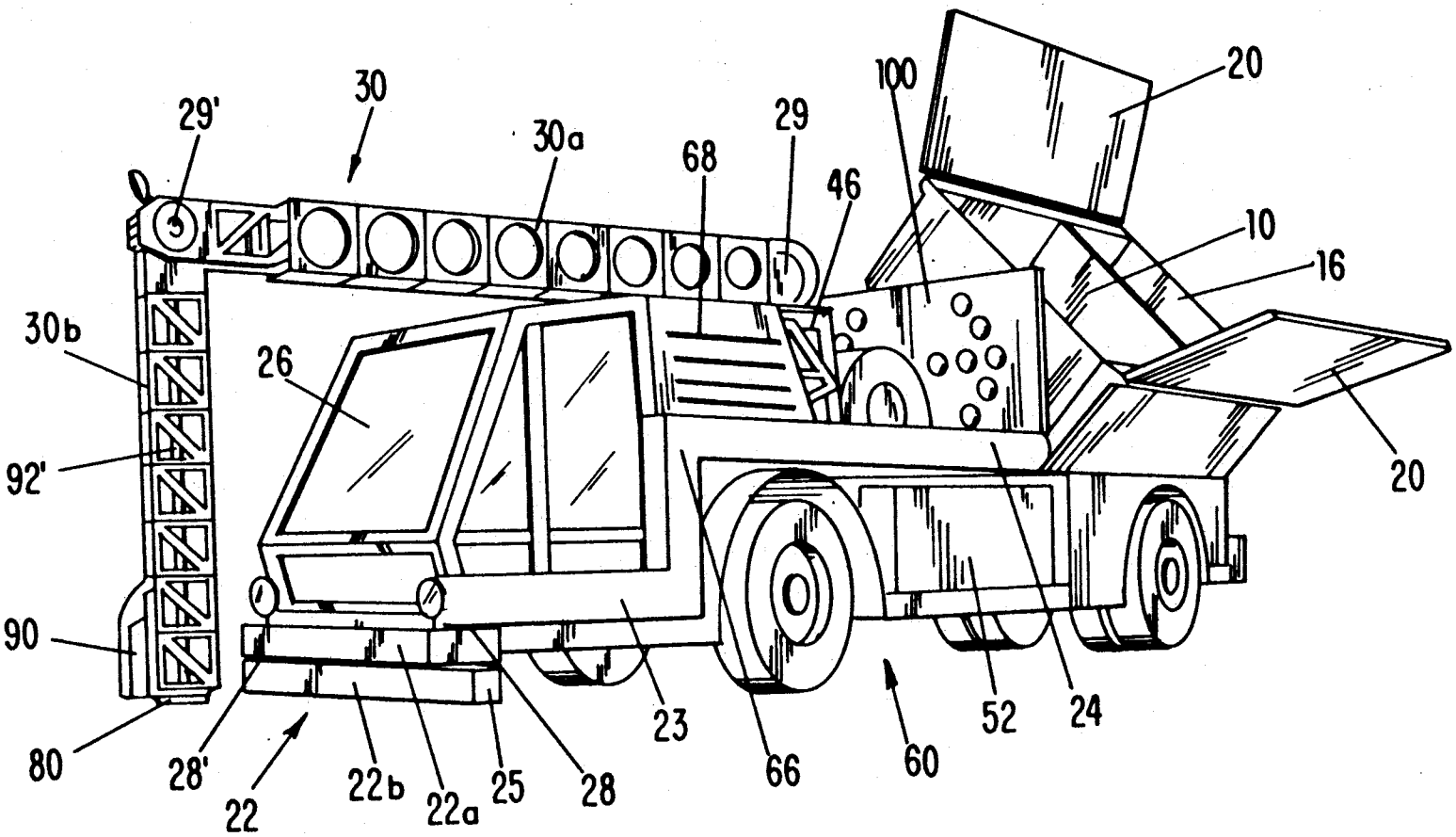
FIG. 1 is a perspective view of the front of the preferred embodiment of the invention.

DESCRIPTION OF THE PREFERRED EMBODIMENT (BEST MODE FOR CARRYING OUT THE INVENTION)

The invention relates to a pavement patching apparatus that is mobile, self-propelled, and self contained. While the invention shall be described with reference to the patching of asphalt pavements, it will be appreciated that many aspects and advantages of the invention may find application in the art of repairing concrete pavement surfaces. The apparatus includes a wheeled vehicle upon which the various devices and equipment used in the repair process are mounted. The invention may be satisfactorily practiced by a single operator, although a plural crew is not precluded. Mounted upon the motorized vehicle frame are a supply hopper for containing the asphalt mixture, a personnel cab, sundry storage tanks, an arm crane, and an articulated conveyor. Attached to the free end of the arm crane are a heater torch assembly, a vacuum assembly, a jackhammer/-compactor assembly, a tack oil sprayer, and a scarifier unit.

Reference is made to the drawings which illustrate the preferred embodiment of the invention. Wheeled chassis 60 of the invention, upon which is mounted, for example, an environmentally-compatible propane internal combustion engine, in an engine compartment 68, and a drive train (not shown) for propelling the vehicle. The apparatus includes a cab 26 enclosing conventional controls e.g. steering wheel, brake controls, throttle and ignition, gearshift, etc., (not shown) for operating the vehicle on a roadway.

A supply hopper 10 is disposed upon the rear half of chassis 60, and comprises a large insulated bin for holding the asphalt patching material. Disposed adjacently to supply hopper 10 is debris storage container 16. Debris storage container 16 shares a common bed with supply hopper 10, but otherwise consists of an entirely separate container whose function is described hereinafter. The supply hopper 10 has covers 20 which are opened during loading, unloading or cleaning. Debris storage container 16 preferably has separate covers which are fitted with a gasket to permit an airtight seal thereof when closed. Alternatively, common covers 20 may sealably enclose supply hopper 10 and debris storage container 16.

The bed of supply hopper 10 and debris storage container 16 is attached to a side of chassis 60 by hinges, such that supply hopper 10 and debris storage container 16 may be swingably tilted toward a side of chassis 60. Located beneath the bed of supply hopper 10 and attached to chassis 60 is a hydraulic tilting mechanism (not shown) of conventional type for tilting the supply hopper 10 toward a side of the vehicle. The hydraulic tilting mechanism is controlled, by means familiar to the art, by the user in cab 26. The precise pitch of the bed of supply hopper 10 is incrementally adjusted by the user, so that the angle of tilt increases proportionally as the supply hopper 10 is emptied of material during the course of operations.

Running the length of supply hopper 10 and debris storage container 16, and extending forward toward the front of the vehicle to alongside cab 26, is a spiral flight transfer auger 14. Transfer auger 14 is journalled at its ends and is rotated by power supplied by the vehicle engine. Transfer auger 14 is disposed at the lower side corner of supply hopper 10 and debris storage container 16, near the aforedescribed hinging mechanism, and is so situated that the supply hopper 10, when tilted upon the hinges, pivots about the transfer auger 14. The forward section of transfer auger 14 is enclosed in an insulated trough 24 with a lid for ease of access.

As transfer auger 14 passes through supply hopper 10, it is open to catch, receive, and transport material contained therein. Transfer auger 14 also runs through debris storage container 16 to the rear of the vehicle, except that within the confines of debris storage container 16 the transfer auger 14 is enclosed within a tube and is thereby separated from the contents of debris storage container 16. Transfer auger 14 is heated by hot oil circulated through the length of hollow central shaft 62. The thermostatically-controlled oil temperature can be adjusted by the operator from the cab 26.

Transfer auger 14 is rotated to transport repair material from supply hopper 10 forward to a bottom opening (not shown) at the front portion, at the drop angle 66, of the covered trough 24. The material will then drop, within eyesight of the operator in cab 26, onto the fixed conveyor arm 23. Transfer auger 14 may be reversed to exhaust materials out the rear of the vehicle for disposal and/or recycling.

Supply hopper 10 supplies material to the transfer auger 14, which operates through the hopper 10. Bed 64 and sides 65 (only one shown) of supply hopper 10 are provided with modular heating units 18 (only one shown) heated by hot circulating oil pumped at precisely controlled temperatures. The supply hopper 10 full of material may be hydraulically tilted to one side, pivoting upon its hinges, to provide a constant supply of material to the heated transfer auger 14. Disposed within the bottom of bed 64 are hydraulic or electric vibrating units to ensure smooth movement by gravity of hot material from supply hopper 10 into transfer auger 14. Hot material is then routed by transfer auger 14 through covered trough 24 to drop angle 66, where it drops onto fixed conveyor arm 23.

Figure 4:
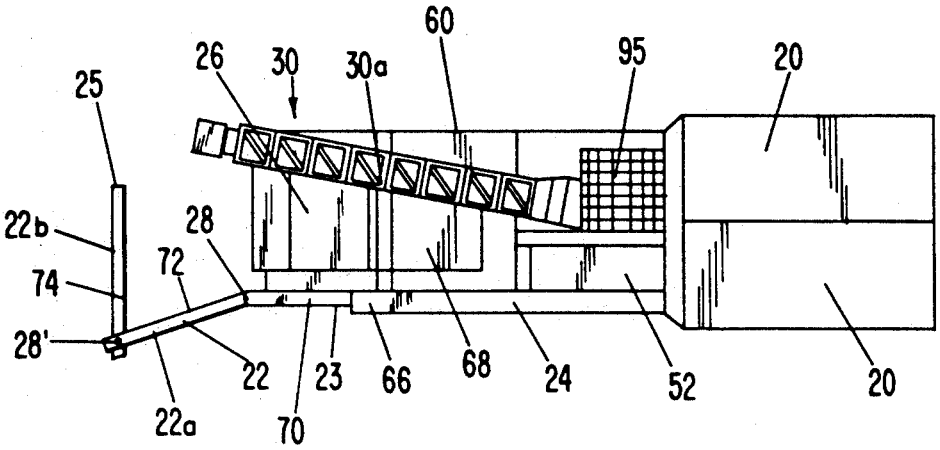
FIG. 4 is a top view of the FIG. 1 embodiment, with the conveyor articulated.

An articulated conveyor arm 22 is rotatably mounted upon the lower left front portion of frame 60, near cab 26 and below and adjacent to fixed conveyor arm 23. Articulated conveyor arm 22 has two sections **22*a* and 22*b* and two swivel joints 28,28'. Shoulder swivel joint 28 and elbow swivel joint 28' afford articulated conveyor arm 22 dramatic flexibility in the horizontal plane, permitting the user to controllably position the conveyor free end 25 over the pavement area to be repaired. The articulated conveyor arm 22 supplies the final amounts and distribution of materials. The articulated conveyor arm 22 reacts similarly to that of a human's arm allowing the delivery end of the articulated conveyor arm 22 to be positioned for controlling the exact amounts and placement of required materials (FIG. 4). The articulating conveyor arm 22 is hydraulically actuated and controlled from the cab 26** by the operator using a multi-position joy stick known in the art.

Fixed conveyor arm 23 and the sections of articulated conveyor arm **22*a*,22*b* are each equipped with a continuous, motor driven, horizontal conveyor belt fashioned of durable flexible material. During operation of the invention, asphalt material deposited upon fixed conveyor arm 23 from transfer auger 14 is transported along the length of fixed conveyor arm 23 by the action of first conveyor belt 70, which is disposed upon and parallel with fixed conveyor arm 23. Upon reaching the distal end of fixed conveyor arm 23, the material drops (by the action of first conveyor belt 70 and gravity) upon a second conveyor belt 72 revolving along the length of first articulated arm section 22*a*. Second conveyor belt 72 in turn transports the material to the proximate end of the second articulated arm section 22*b*, where the material falls upon a third conveyor belt 74, which carries the material to the conveyor free end 25. The action of third conveyor belt 74 permits a measured amount of material to fall by gravity to the roadway pavement below conveyor free end 24**.

The three conveyor belts 70,72,74 are preferably operated simultaneously, but may alternatively be individually actuated, by the user in cab 26. It is noted that the relative positions of cab 26 and articulated conveyor arm 22 allow the user to observe the position of articulated conveyor arm 22 and the transportation of material on conveyor belts 70,72,74 at all times.

Figure 5:
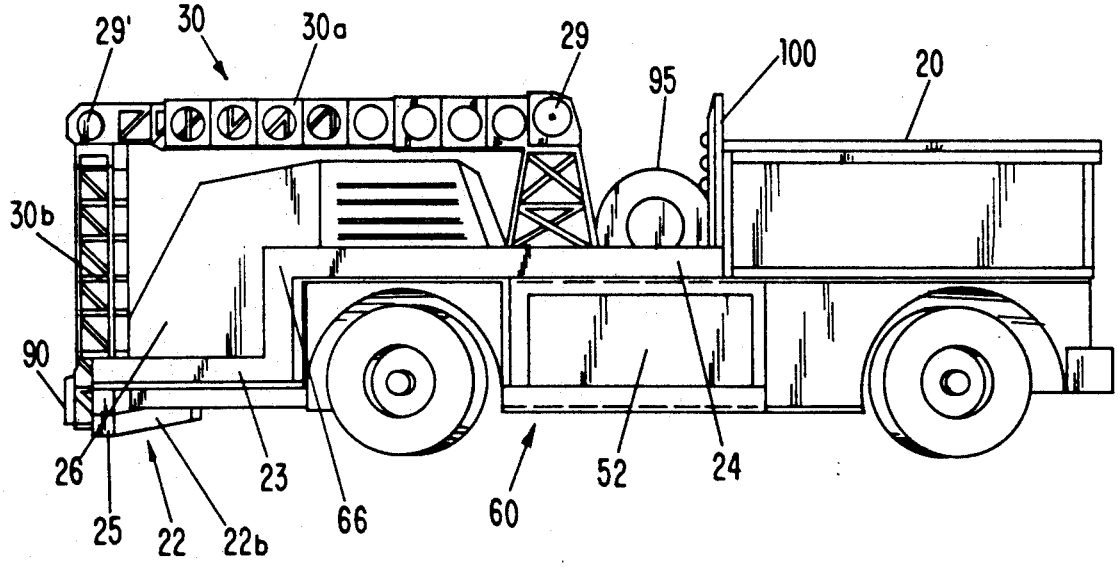
FIG. 5 is a side view of the preferred embodiment of the invention (except for auger system, other side is substantially the same)
Figure 6:
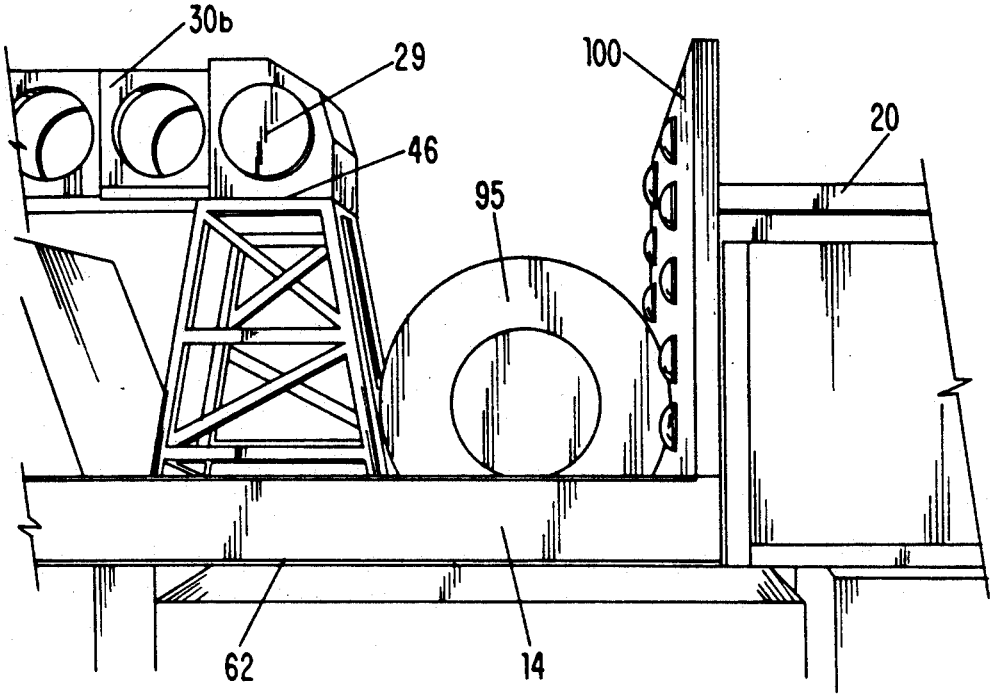
FIG. 6 is a side view of the embodiment of FIG. 5, with a partial cutaway view of the transfer auger system.
Figure 11:
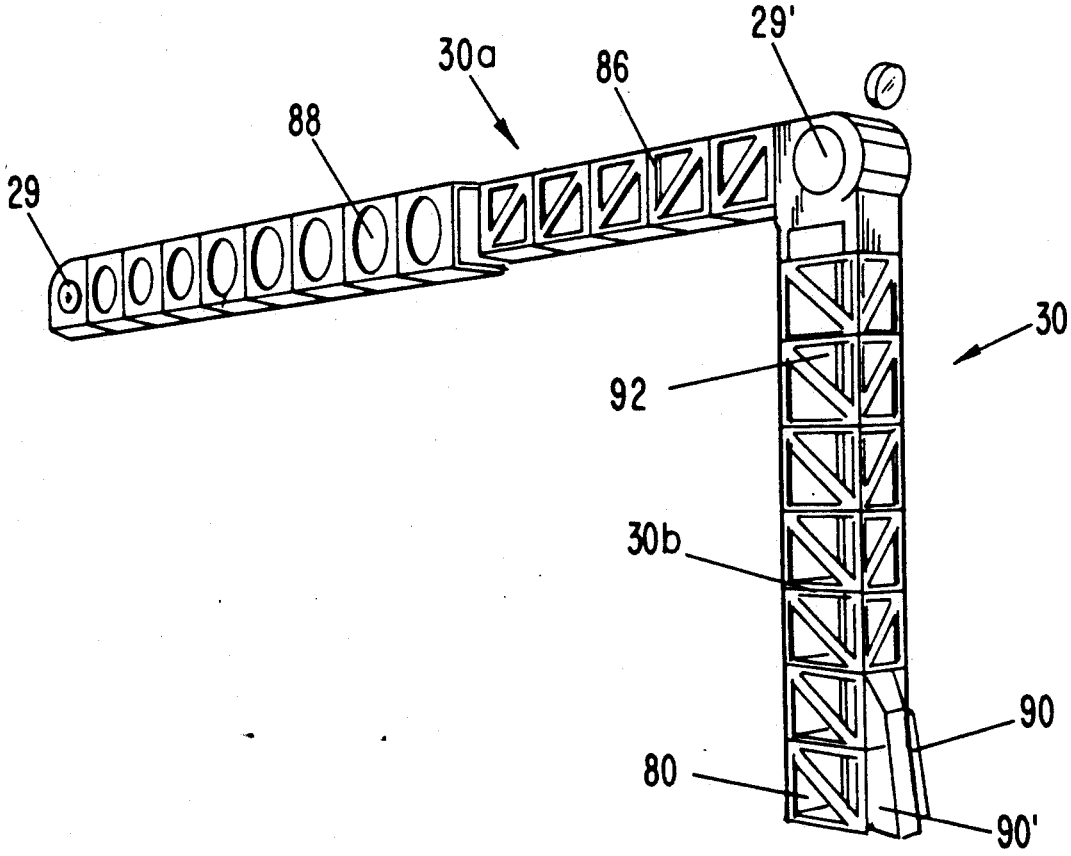
FIG. 11 is a perspective view of the crane arm.

FIGS. 5 and 11 illustrate the overhead crane arm 30, which supports the various working implements of the apparatus, to be further described herein. Crane arm 30 is attached to frame 60, behind engine compartment 68, above the transmission and near the center of the vehicle. The crane arm 30 extends forwardly over the top of the low-profile cab 26. The low profile design of the vehicle ensures the ability to perform repairs in parking garages and under bridges. The mounting location enables the crane arm 30 to be moved into all positions within the operator's vision. The crane arm 30 has the capacity to move vertically, accommodating the various levels of the roadway terrain. The crane arm 30 also has the capability to move smoothly in and out, left to right and up and down in order to position the implements and systems over various locations. Crane arm 30 is controlled from the cab 26 by the operator, using a single six-position "joy stick," having up/down, left/-right, in/out capabilities. The radius of the crane arm's 30 reach is preferably approximately 10 feet. The user's manipulation of the crane arm 30 controls the position of the required implements and applicators, as hereafter described.

Crane arm 30 is composed of an horizontal section **30*a* and a vertical section 30*b*. The crane arm 30 has two swivel joints 29,29' and rotating mount 46. Crane arm swivel joints 29,29' permit crane arm 30 substantial motion in a vertical plane, while rotating mount 46 permits crane arm 30 to be rotated about a vertical axis. The movement of horizontal section 30*a* and vertical section 30*b* is by standard hydraulic means known in the art, and is controlled by the user. Rotation of crane arm 30 upon rotating mount 46 is accomplished through a power take-off from the vehicle's drive train, and likewise directed from cab 26. It will be appreciated that the rotational and flexible movements of crane arm 30 permit the user easily and quickly to position the implement end 80 of crane arm 30** above the pavement area to be repaired; the user is permitted to take account and compensate for changes in pavement elevation due to curbs, small hills, etc.

Figure 2:
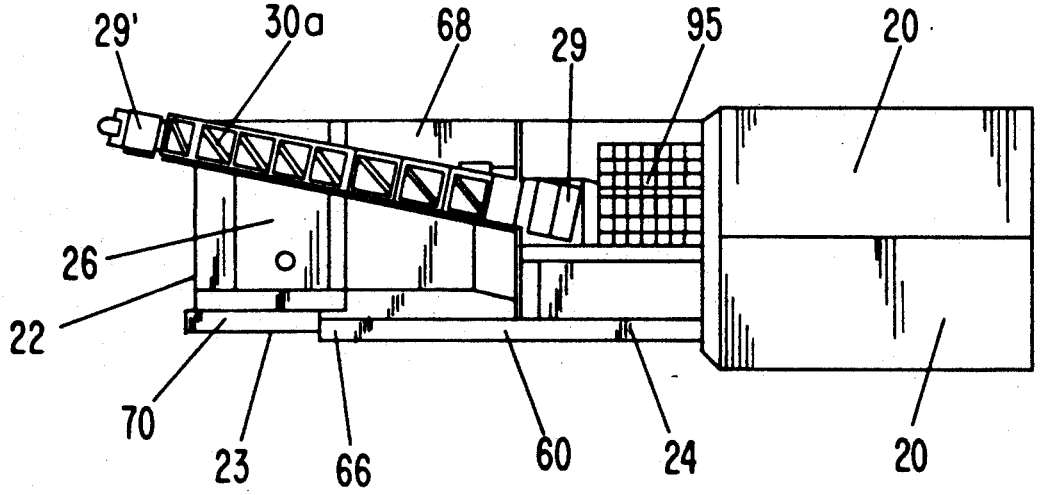
FIG. 2 is a top view of the FIG. 1 embodiment, showing the crane arm and the conveyor system.
Figure 3:
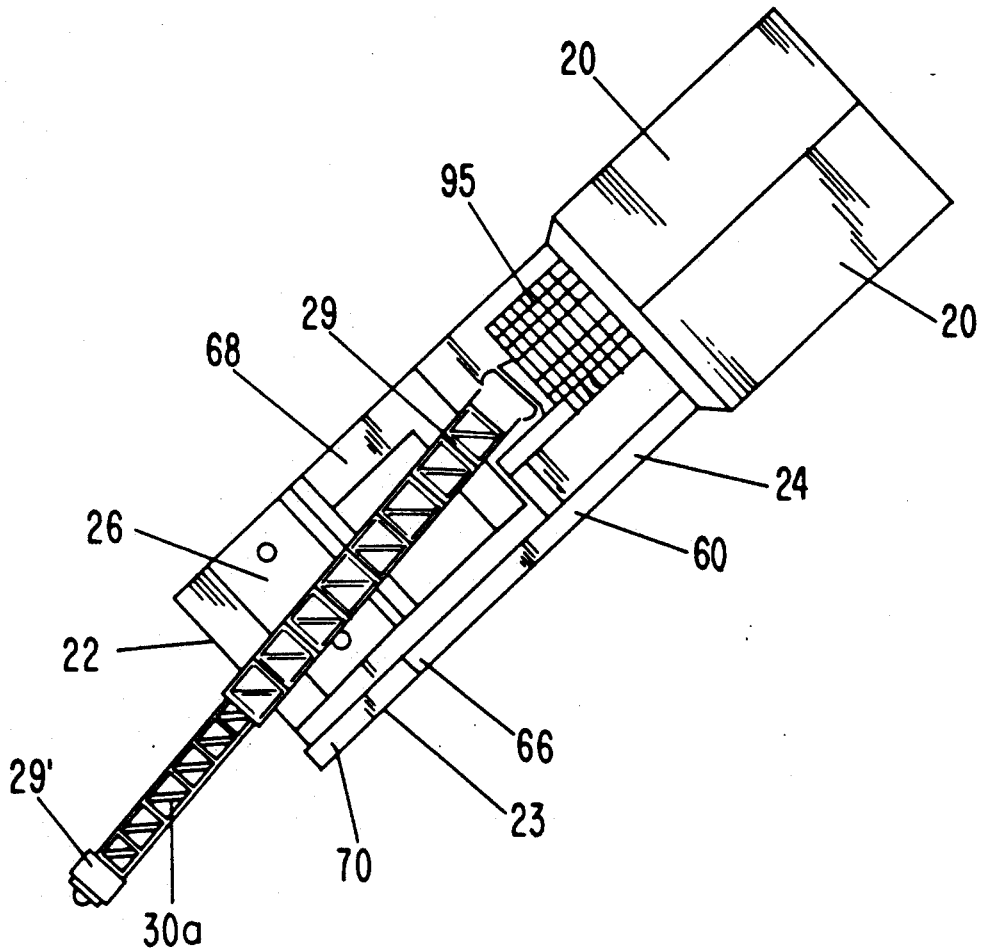
FIG. 3 is a top view of the FIG. 1 embodiment, showing the crane arm in extended position.
Figure 9:
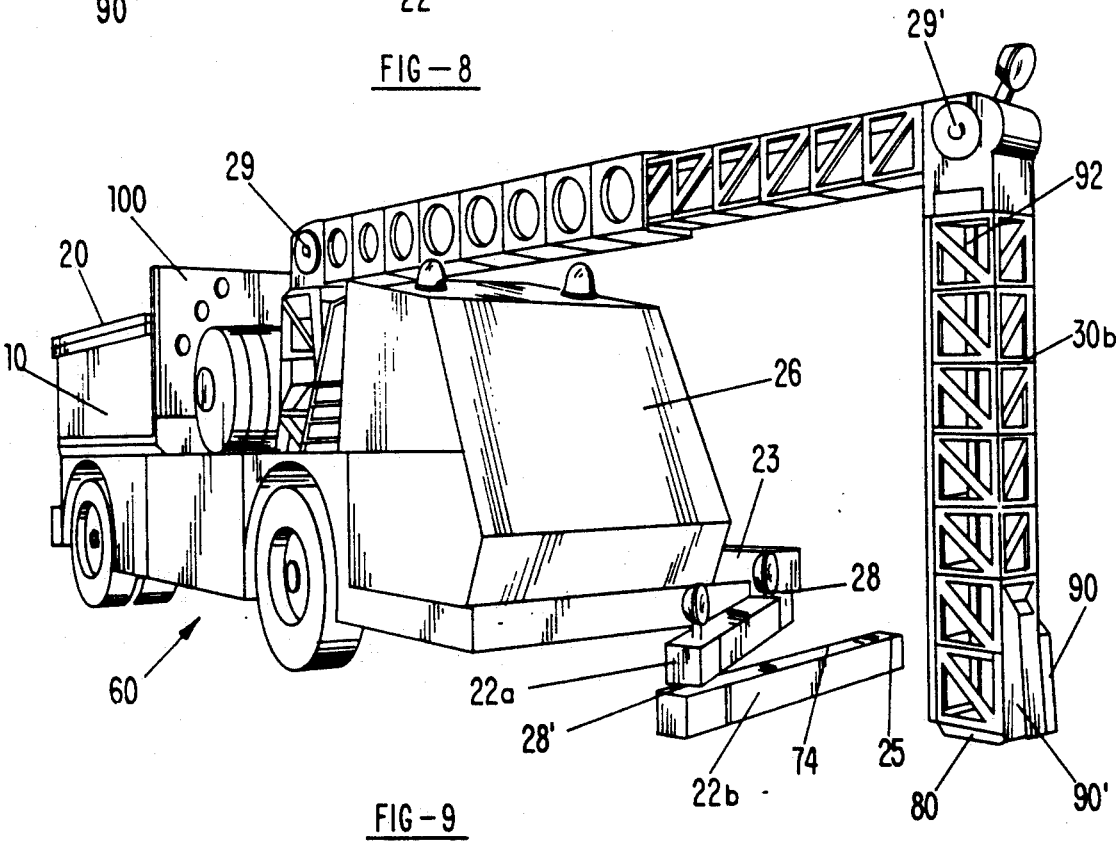
FIG. 9 is a front view of the embodiment of FIG. 1, showing the crane/arm extended and conveyor articulated.

FIG. 11 illustrates that crane arm 30 preferably includes a telescopic feature in horizontal section **30*a*. Horizontal section 30*a* is comprised of a distal component 86 capable of being retracted, by hydraulics, into the proximal component 88 which is attached to the rotating mount 46. This telescopic aspect of crane arm 30 allows the user to move and position the implement end 80 within the horizontal plane while keeping implement end 80 the requisite distance above the pavement surface, as best illustrated in FIGS. 5 and 9. Also, the telescopic extension of horizontal section 30*a* allows vertical section 30*b* of crane arm 30 to be properly positioned during the repair procedure (FIG. 3), while telescopic retraction allows vertical section 30*b* to be pulled in near cab 26 while the vehicle operates over the highway en route to or from a repair site (FIG. 2**).

Figure 8:
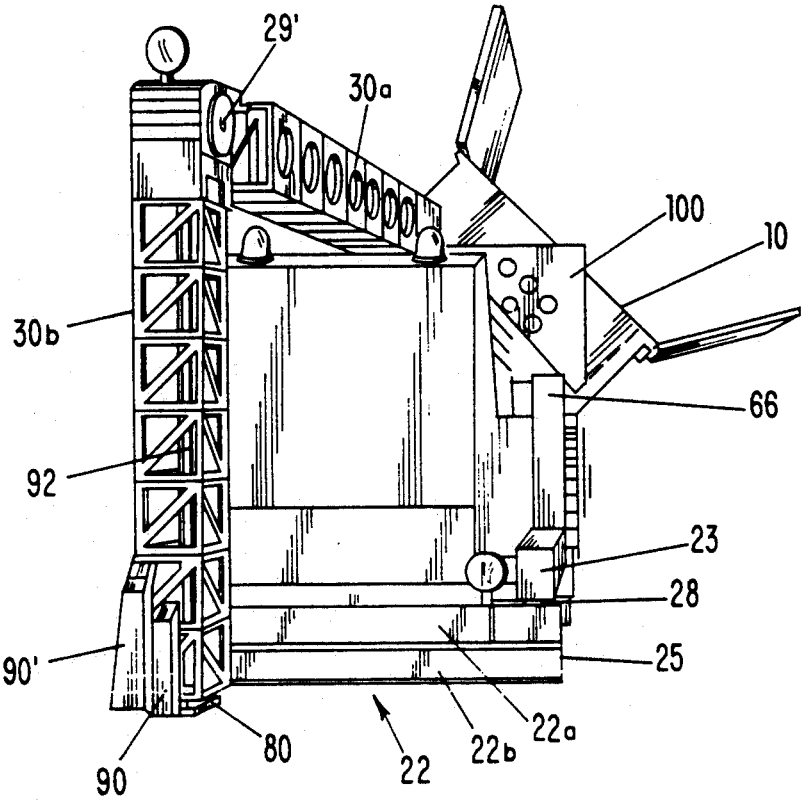
FIG. 8 is a front view of the embodiment of FIG. 1.
Figure 12:
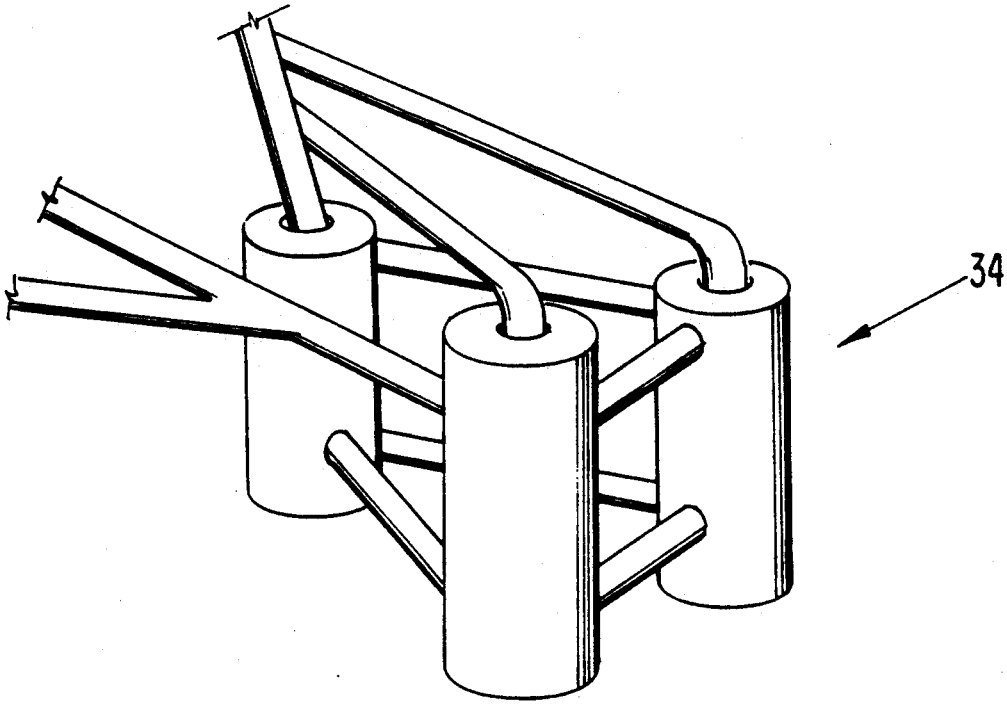
FIG. 12 is a view of the multiheaded torch apparatus of the invention.
Figure 13:
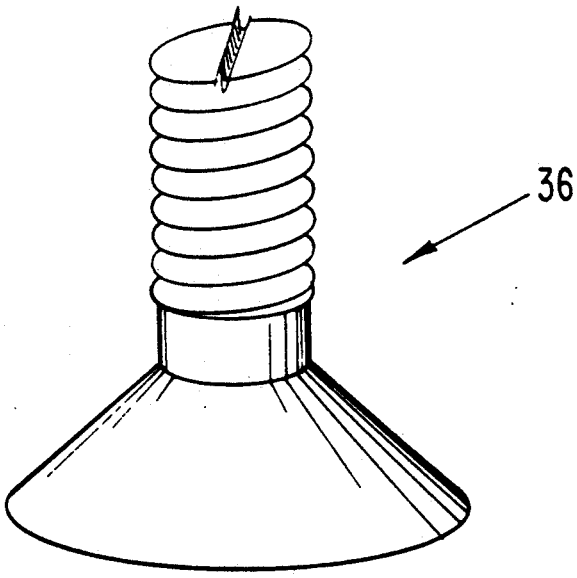
FIG. 13 is a view of the vacuum head of the apparatus of the invention.
Figure 14:
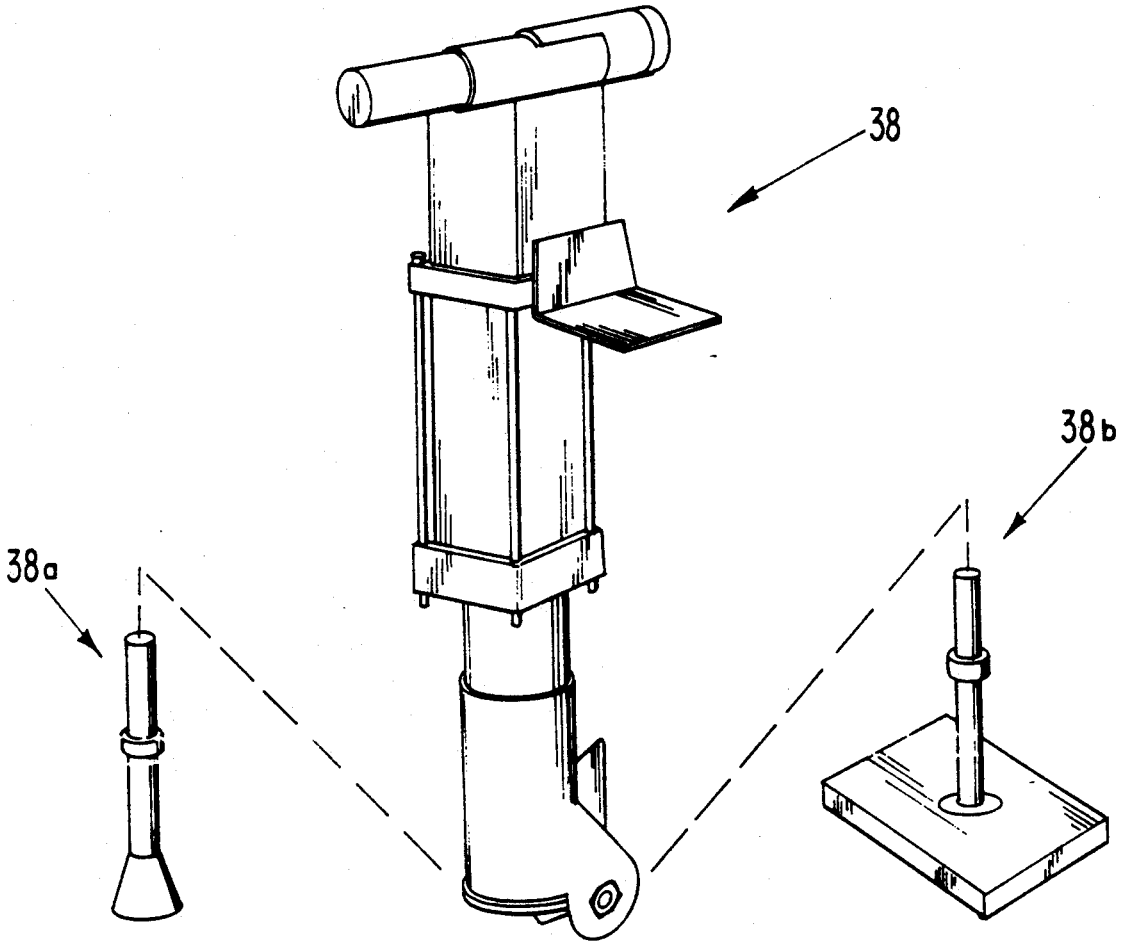
FIG. 14 is a view of the compactor/jackhammer unit of the invention, showing the interchangeable chisel tool and compactor heads used therein.
Figure 15:
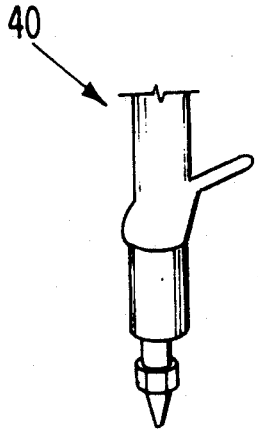
FIG. 15 is a view of the tack oil sprayer system of the invention.
Figure 16:
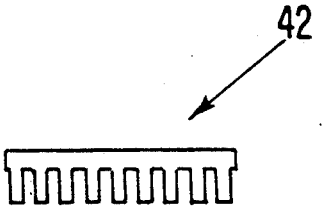
FIG. 16 is a view of the scarifier unit of the invention.

As partially shown in FIG. 8, the implement end 80 at the distal end of vertical section 30*b* of the crane arm 30 is provided with implement housings 90,90′ which house the multi-headed torch 34, the jackhammer/compactor unit 38 and the tack oil sprayer 40, individually depicted at FIGS. 12, 14 and 15, respectively. Also disposed on implement end 80 are the vacuum head 36 and the scarifier unit 42, shown at FIGS. 13 and 16. As indicated in FIG. 14, the jackhammer/compactor unit 38 utilizes interchangeable tools; it may be fitted with jackhammer chisel 38*a* or compactor head 38*b*, depending upon the repair step to be accomplished. The user initially may manually install the jackhammer chisel 38*a* prior to preparing a pothole for repair, and then later may interchange the compactor head 38*b* prior to compacting the patch material.

Service lines (not shown) to the various patching implements disposed upon the implement end 80 are contained and routed by a line conduit 92. Line conduit 92 is disposed within crane arm 30, and runs from implement end 80 to the main body of the vehicle. Line conduit 92 is flexible or hinged to permit its movement with the movement of crane arm 30. Service lines include a pneumatic or electrical line running from corresponding power sources on the chassis 60 to the jackhammer/compactor unit 38, a propane line running from propane tank 95 to multi-headed torch 34, an electrical line to multiheaded torch 34, an oil line running from an oil tank (not shown) disposed on the chassis 60 to the tack oil sprayer 40, and a vacuum line between an on-board high-velocity vacuum pump (not shown) and the vacuum head 36.

An advantage of the present invention is that various implement service lines are adjacently routed, insofar as possible, within a common line conduit 92. An auxiliary tubular line (not shown) preferably is disposed within the common line conduit 92, and contains oil or water heated by the vehicle engine and circulated by pump through the auxiliary line. By this means, the present invention maintains the service lines—particularly the tack oil line—at an acceptable working temperature. Because the tack oil sprayer 40 is used only intermittently, its service line is prone to clogging (especially in cool weather), a problem overcome by the auxiliary heating line of the invention.

On the side of this vehicle will be mounted tanks 52 for the storage, transportation and heating of the liquid materials; such as asphalt, water, diesel (described below). The heating of these tanks 52 will be by vehicle engine liquid during transporting, and by heat transferred from the hot oil during down times. These tanks 52 will be modular, easily removed and/or replaced and will be fully insulated.

Figure 10:
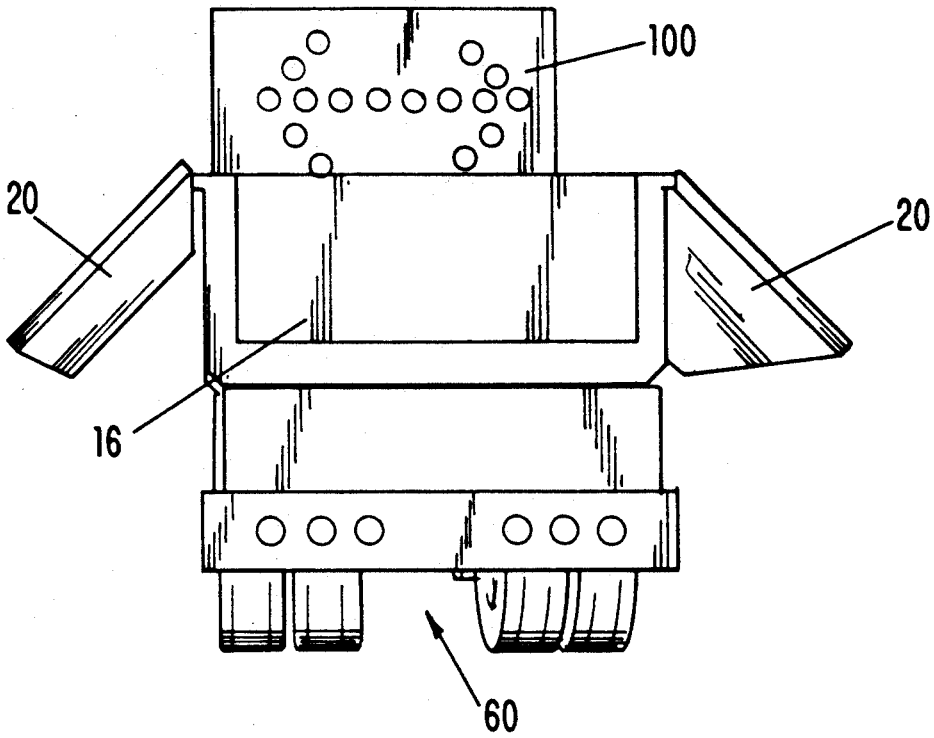
FIG. 10 is a rear view of the embodiment of FIG. 1, showing the arrow board in an operational position (up) and covers open.

Mounted vertically upon chassis 60 is arrow board 100 of the type known in the art for alerting motorists to the presence of the apparatus and directing them to detour. Arrow board 100 preferably may be raised and lowered, such that arrow board 100 is lowered when the apparatus is driving along a highway (FIG. 1) and raised when a repair is in progress (FIG. 10).

In view of the foregoing, the preferred manner of practicing the invention is apparent. The vehicle of the invention is driven to an asphalt "hot plant" or other patching material source. As shown in FIG. 10, the covers 20 are opened (manually or hydraulically). Supply hopper 10 is filled with the desired quantity of hot material; a completely full supply hopper 10 will permit the invention to effectuate numerous individual minor repairs without need to return for material refilling. The covers 20 are closed (FIG. 5) and the contained material is maintained within the insulated supply hopper 10. Modular heating units 18 (FIG. 7) in the sides 65 and or bed 64 of supply hopper 10 are actuated to maintain the material at the requisite working temperature.

The crane arm 30 and articulated conveyor arm 22 are fully retracted and positioned in front of cab 26 (FIGS. 2 and 5). The vehicle of the invention is thus in condition to be driven to job locations. Cab 26 can accommodate a driver and one or two additional crew or flagmen, if desired.

During the course of operation of the apparatus, hot oil is pumped through the tubes of a recirculating heating system to maintain ideal temperatures in the supply hopper 10 and also in emulsion tank 52 and other liquid tanks disposed upon chassis 60 as desired.

Upon arrival at a given repair location, the arrow board 100 is raised and actuated to warn and direct passing motorists. The user manipulates the joysticks and levers within cab 26 in order to position the implement end 80 of crane arm 30 over and immediately above the pothole or damaged pavement to be repaired. The user may telescopically extend the crane arm horizontal section 30*a* (FIGS. 3 and 9), and swivel the two sections of crane arm 30*a*,30*b* about swivel joints 29,29′ as necessary to attain proper positioning of implement end 80. All the repair implements mounted on implement end 80 are remotely controllable from cab 26 via electrical leads and switching.

The compactor/jackhammer unit 38 is mounted to the implement end 80 of overhead crane arm 30, and has interchangeable tools. Initially, the user may utilize the cutting/breaking chisel 38*a* (FIG. 14) in the compactor/jackhammer unit 38 in order to groom the pavement for repair (by breaking away and pulverizing damaged portions, shaping potholes, etc.) as needed to assure a strong repair. Compactor/jackhammer unit 38 preferably is pneumatically operated, but alternatively may be electrically or hydraulically powered. The unit 38 preferably can be hydraulically raised and lowered from within vertical section 30*b* of crane arm 30 to allow for irregular terrain.

Properly positioning the implement end 80 (horizontally and vertically) positions the high velocity vacuum head 36 over the area to be repaired. Preferably, vacuum head 36 also may be hydraulically extended and retracted from within implement end 80 further to accommodate irregular terrain and provide maximum removal of debris. The vacuum system removes loose debris from the damaged pavement, and deposits it into debris storage container 16 mounted on the vehicle. The suction for the vacuum head 36 is provided by a roots blower/vacuum, vacuum changer or equivalent familiar to street maintenance art. The vacuum head 36, vacuum pump and debris storage tank 16 are connected by suction hoses. A thusly cleaned repair area results in a more permanent repair.

The function of multiheaded torch 34 is to heat the damaged asphalt to a temperature sufficient to allow the scarifying of the old asphalt, guaranteeing a seamless, pyro-chemcial bond between the old and new asphalt. The operator has the ability to achieve auto pre-ignition of the torches, choose from high or law flame, and hydraulically raise/lower the torch assembly 34 from the cab 26.

After thoroughly vacuuming the area to be repaired, the operator electrically ignites the multiheaded torch 34 and directs the heat thereof over the area to be repaired, all the while moving about implement end 80 as needed to heat the damaged pavement area. After the damaged asphalt has been heat softened, crane arm 30 is moved to place scarifier unit 42 in contact with the damaged pavement, and then further moved back and forth to scarify the pavement surface in order to disrupt and loosen the surface of the old asphalt to achieve the pyro-chemical bond.

The tack oil sprayer 40, fully operational from the cab 26, is mounted on implement end 80 of overhead crane arm 30. After scarifying the damaged pavement, the user activates the tack oil sprayer 40 to deposit a thin coat of tack oil upon the surface of the repair area. This tack oil layer acts as a catalyst for the old and new materials. The tack oil supply hoses (not shown), running through line conduit 92 and feeding the tack oil sprayer 40, are heated by liquid from the vehicle's engine, eliminating tack oil sprayer 40 nozzle clogging during inclement weather conditions. By manipulating crane arm 30 controls in cab 26, the operator is able to position, move, and control discharge from the tack oil sprayer 40.

After spraying a desired film of tack oil emulsion to the repair surface, the user again fires the mutiheaded torch 34 and moves implement end 80 about and above the repair area to dry the tack oil emulsion. After curing the tack oil to the desired degree, the user again extinguishes the torch 34, and moves crane arm 30 to one side.

With crane arm 30 moved aside, the user is able to utilize articulated conveyor arm 22 to accomplish a measured and targeted placement of patching material into the pothole or damaged area. Using conventional controls within low-profile cab 26, the operator activates the hydraulics of articulated conveyor arm 22. As best illustrated in FIG. 4, the shoulder swivel joint 28 and elbow swivel joint 28' in articulated conveyor arm 22 allow tremendous flexibility in the positioning of articulated conveyor arm 22. Clearly observing the movements of the sections 22*a*,22*b* of articulated conveyor arm 22, the user is able precisely to position free end 25 of articulated conveyor arm 22 above the area to be prepared. Such precision placement allows precise deposition of patching material. Upon being thus properly positioned, articulated conveyor arm 22 is locked in such position, and its second and third conveyor belts 72,74 turned on.

Reference is made to FIGS. 4 and 9. First conveyor belt 70 on fixed conveyor arm 23 is turned on. User then actuates transfer auger 14, which draws hot patch material from supply hopper 10 and pushes it forward within covered insulated trough 24. With continued operation of transfer auger 14, patching material arrives at drop corner 66, where it drops through hole in bottom of insulated trough 24 and falls to first conveyor belt 70 on fixed conveyor arm 23. First conveyor belt 70 then carries material to distal end of fixed conveyor arm 23, where material drops to second conveyor belt 72, which runs the length of first articulated arm section 22*a* (whatever its particular relative position may be). The material is carried by second conveyor belt 72 to the distal end of first articulated conveyor arm section 22*a*, where drops to third conveyor belt 74 on second articulated conveyor arm section 22*b*. Third conveyor belt 74 transports the material the length of second articulated arm section 22*b* to free end 25, where the hot patch material falls into the pothole or onto the pavement area to be repaired. The rate of patch material deposition is controlled by the user, who can adjust the speeds of the transfer auger 14 and the conveyor belts 70,72,74.

Figure 7:
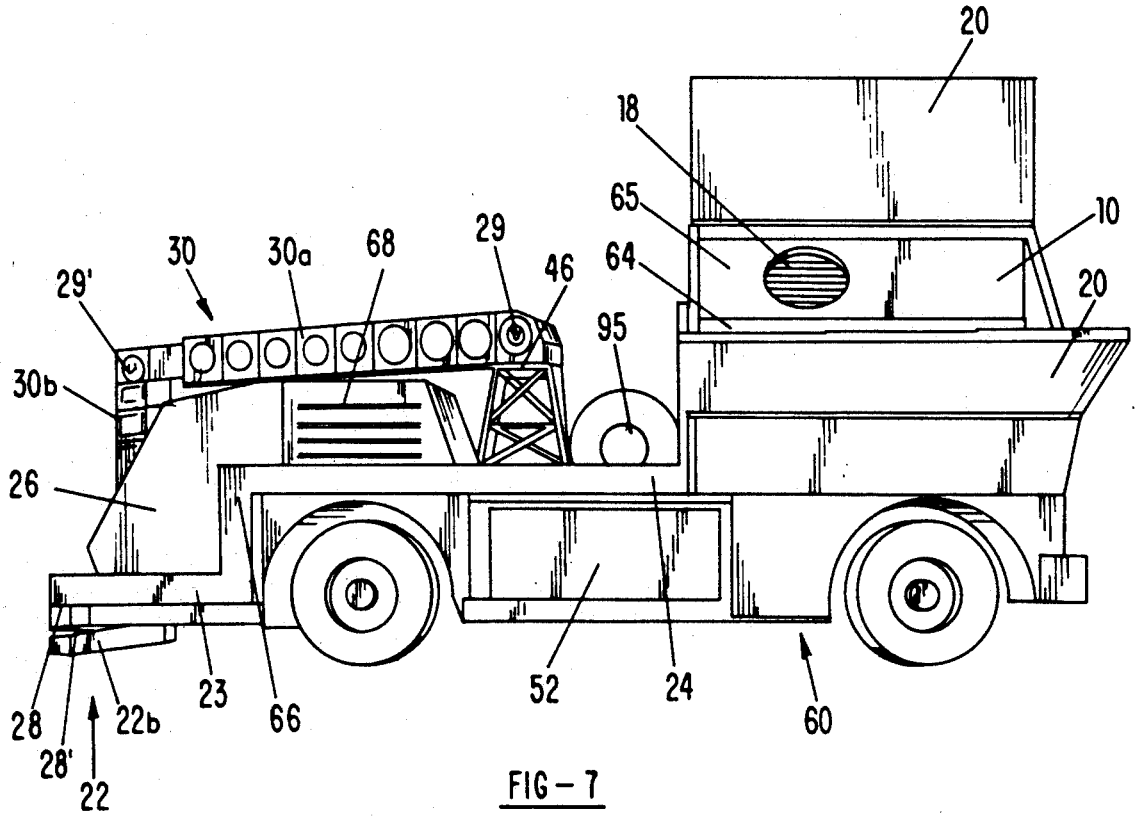
FIG. 7 is a side view of the embodiment of FIG. 5, showing the hopper tilted up and the covers open for loading or maintenance. A cut away view of the modular heating units is also shown.

A full supply hopper 10 will have a nearly level bed 64. Gravity causes material in a full hopper to fall into transfer auger 14. During the course of a series of individual repairs the quantity of hot material in supply hopper 10 will decrease. By incrementally tilting supply hopper 10 to an ever increasing pitch, user maintains an adequate gravity flow of material into transfer auger 14, which is always located at the lowest side of tilted supply hopper 10 (FIGS. 1, 7 and 8). Assisted by electric or pneumatic vibrators located in bed 64 of supply hopper 10, material will always fall toward the side of supply hopper 10 where transfer auger 14 is located. The user, however, is able to avoid gravity-induced overcompaction of material by increasing the tilt of supply hopper 10 no more than needed to gradually empty supply hopper 10 via transfer auger 14. The maximum tilt of supply hopper 10 ordinarily will occur, therefore, just as the final volume of material falls into transfer auger 14.

Once the desired quantity of material has been deposited into the area to be patched, the user retracts and folds the articulated conveyor arm 22 to its protected location immediately in front of the cab 26. With experience, a user will learn when to idle the transfer auger 14 to avoid having excess material remaining upon conveyor belts 70,72,74 after the needed quantity of material has been deposited on the pavement.

If needed, the chisel tool 38*a* in compactor/jackhammer unit 38 is removed and replaced with the compactor head 38*b*. The user once again positions the implement end 80 immediately above the area to be repaired, and lowers the compactor/jackhammer unit 38 (bearing compactor head 38*b*) to the deposited patch material. The crane arm 30 is motioned laterally so that the user may use compactor head 38*b* as a trowel to level and smooth the deposited patch material. (Additional crew members using hand rakes or shovels may assist in material smoothing and leveling, if desired.) Pneumatically powered, the compactor/jackhammer unit 38 then reciprocates compactor head 38*b*, which compacts and tamps the hot patch material into the surface to be repaired. The horizontal movements of the compactor head 38*b* is precisely controlled from cab 26.

Subsequent to the smoothing and tamping of the patch material, excess material may be vacuumed through vacuum head 36 and into debris storage container 16 for later recovery. The smoothed and compacted repair is again sprayed with a fine film of tack oil emulsion from tack oil sprayer 40. The multiheaded torch 34 is fired and moved about immediately above the repair to dry the emulsion and seal the repair. The crane arm is retracted to traveling position, and the vehicle of the invention is able to drive to the next repair site.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above, and of the corresponding application are hereby incorporated by reference.

What is claimed is:

1. An apparatus for repairing an area of pavement comprising:

means comprising a wheeled chassis;

means comprising an articulated crane upon said chassis;

means for storing materials on said chassis; and means for transporting said materials from said storing means to the pavement area to be repaired.

2. The apparatus of claim 1 wherein said means comprising an articulated crane further comprises means for rotatably attaching said articulated crane to said chassis.

3. The apparatus of claim 1 wherein said means comprising an articulated crane further comprises vertical section means and horizontal section means.

4. The apparatus of claim 3 wherein said means comprising an articulated crane further comprises pivotal connection means thereby permitting relative vertical movement between said vertical section means, said horizontal section means, and said chassis.

5. The apparatus of claim 3 wherein said horizontal section means further comprises means for extending and retracting said horizontal section means.

6. The apparatus of claim 3 wherein said vertical section means further comprises a plurality of pavement repair implements.

7. The apparatus of claim 6 wherein said plurality of pavement repair implements further comprise means for reciprocating said plurality of pavement repair implements.

8. The apparatus of claim 6 wherein said plurality of pavement repair implements comprises at least one jackhammer.

9. The apparatus of claim 6 wherein said plurality of pavement repair implements further comprises at least one compactor.

10. The apparatus of claim 6 wherein said plurality of pavement repair implements further comprises at least one multi-headed torch.

11. The apparatus of claim 6 wherein said plurality of pavement repair implements further comprises at least one sprayer.

12. The apparatus of claim 6 wherein said plurality of pavement repair implements further comprises at least one vacuum head.

13. The apparatus of claim 6 wherein said plurality of pavement repair implements further comprises at least one scarifier means.

14. The apparatus of claim 1 wherein said means for storing materials further comprises means for storing pavement repair materials and detritus.

15. The apparatus of claim 14 wherein said means for storing pavement repair materials comprises controllably tiltable hopper means.

16. The apparatus of claim 15 wherein said means for storing pavement repair materials further comprises heating means.

17. The apparatus of claim 1 wherein said means for transporting materials comprises a plurality of conveyor means for transporting pavement repair materials to the pavement area to be repaired.

18. The apparatus of claim 17 wherein at least one of said plurality of conveyor means comprises auger means.

19. The apparatus of claim 17 wherein at least one of said conveyor means comprises horizontally pivotable conveyor means.

20. The apparatus of claim 1 further comprising:

means for containing debris on said chassis; and means for transporting the debris from the pavement area to be repaired to said containing means.

21. The apparatus of claim 20 wherein said debris transporting means comprises vacuum means for transporting debris from the pavement area to be repaired.

22. A method of repairing an area of pavement comprising the steps of:

(a) providing a wheeled chassis;

(b) mounting an articulated crane on the chassis;

(c) storing materials on the chassis; and (d) transporting the materials from storage on the chassis to the pavement area to be repaired.

23. The method of claim 22 wherein the step of mounting an articulated crane on the chassis further comprises the step of rotatably attaching the articulated crane to the chassis.

24. The method of claim 23 wherein the step of mounting an articulated crane on the chassis further comprises the step of pivotably connecting a vertical crane section, a horizontal crane section and the chassis.

25. The method of claim 22 wherein the step of pivotably connecting a vertical crane section, a horizontal crane section and the chassis further comprises the step of extending and retracting the horizontal crane section.

26. The method of claim 24 wherein the step of pivotably connecting the vertical crane section, a horizontal crane section and the chassis further comprises the step of mounting a plurality of pavement repair implements on the vertical crane section.

27. The method of claim 26 wherein the step of mounting a plurality of pavement repair implements on the vertical crane section further comprises the step of reciprocating the plurality of pavement repair implements.

28. The method of claim 22 wherein the step of storing materials on the chassis further comprises the step of storing pavement repair materials and detritus.

29. The method of claim 28 wherein the step of storing pavement repair materials further comprises the step of controllably tilting a hopper.

30. The method of claim 28 wherein the step of storing pavement repair materials further comprises the step of heating the pavement repair materials.

31. The method of claim 21 wherein the step of transporting the materials further comprises the step of providing a plurality of conveyors for transporting pavement repair material to the pavement area to be repaired.

32. The method of claim 31, wherein the step of providing a plurality of conveyors further comprises the step of providing at least one auger.

33. The method of claim 31 wherein the step of providing a plurality of conveyors further comprises the step of horizontally pivoting at least one conveyor.

34. The method of claim 22 further comprising the steps of:

(a) placing a debris container upon the chassis; and (b) transporting debris from the pavement area to be repaired to the container on the chassis.

35. The method of claim 34 wherein the step of transporting debris comprises the step of vacuuming debris from the pavement area to be repaired.

* * * * *